US008056191B2

(12) United States Patent
Crye et al.

(10) Patent No.: US 8,056,191 B2
(45) Date of Patent: Nov. 15, 2011

(54) LOW-PROFILE ADJUSTABLE BUCKLE

(75) Inventors: Caleb Clark Crye, Brooklyn, NY (US); Scott D. Shinkle, Bear Creek Township, PA (US)

(73) Assignee: LineWeight LLC, Brooklyn, NY (US)

( * ) Notice: Subject to any disclaimer, the term of this patent is extended or adjusted under 35 U.S.C. 154(b) by 617 days.

(21) Appl. No.: 12/239,142

(22) Filed: Sep. 26, 2008

(65) Prior Publication Data

US 2009/0083948 A1 Apr. 2, 2009

Related U.S. Application Data

(60) Provisional application No. 60/975,737, filed on Sep. 27, 2007.

(51) Int. Cl.
*A44B 11/00* (2006.01)
*A44B 11/25* (2006.01)

(52) U.S. Cl. ..... 24/197; 24/168; 24/184

(58) Field of Classification Search ..... 24/197, 24/168, 184, 306, 442, 307, 163 R, 182
See application file for complete search history.

(56) References Cited

U.S. PATENT DOCUMENTS 686,934 A * 11/1901 Clark ..... 24/168
2,563,809 A * 8/1951 Ash ..... 24/197
2,853,757 A 9/1958 Rave
3,277,543 A * 10/1966 Gaylord ..... 24/193
3,407,452 A * 10/1968 Abert et al. ..... 24/197
3,813,734 A * 6/1974 Schauweker et al. ..... 24/200
4,414,713 A 11/1983 Prete, Jr.
4,670,945 A * 6/1987 Banks ..... 24/170
4,962,572 A 10/1990 Prentkowski
5,205,021 A 4/1993 Durand
5,432,984 A * 7/1995 Petzl ..... 24/197
5,915,535 A * 6/1999 Henrekin-Jordan ..... 2/195.2
6,170,091 B1 1/2001 Zide et al.
6,539,592 B1 4/2003 Choi et al.
7,100,249 B2 9/2006 Hurn

* cited by examiner

*Primary Examiner* — Robert Sandy
*Assistant Examiner* — Louis Mercado
(74) *Attorney, Agent, or Firm* — Stiennon & Stiennon

(57) ABSTRACT

A lightweight, secure, and low profile adjustable locking buckle has a first steel loop which overlies a second steel loop with a rear member spaced from a front member by two side members. The first loop front member has a forward projection which extends frontwardly and is dimensioned to fit within a central opening in the second loop. Each side member of the second loop has a ramped portion, such that the front member is spaced upwardly from the rear member. A fixed strap encircles the rear portions of the first loop and the second loop and is fixed to a supporting element. An adjustable strap extends beneath the first loop front portion and the second loop front portion, turns over the first loop forward projection and beneath the second loop front portion to be releasably secured to itself. Side tabs may be formed on the loops to facilitate adjustment.

11 Claims, 2 Drawing Sheets

LOW-PROFILE ADJUSTABLE BUCKLE

CROSS REFERENCES TO RELATED APPLICATIONS

This application claims the benefit of U.S. provisional 60/975,737, filed Sep. 27, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to mechanical attachment mechanisms in general, and more particularly to mechanisms for releasably connecting a flexible strap to another element.

In attaching ballistic armor vests to a soldier or police officer, it is necessary to adjust the segments of armor to a proper fit to properly position the armor and to restrain unnecessary movement of the armor. This is usually achieved in part by a system of flexible straps which are received within buckles.

Current solutions either rely on a buckle having a single loop which is weak and prone to breaking (plastic) or bending (metal). The market continues to use these because it rarely sees them break. They generally function acceptably well for daily use, but break immediately in emergency situations such as when wounded persons must be dragged by their gear to safety or lifted by their gear into a vehicle.

In some prior art arrangements, a double loop is used to add friction. One problem with this configuration is that it still puts the vast majority of the force on to a single loop. The double loop buckle assembly adds more friction than the single loop, but can slip as more force is applied. Additionally, the two loops can move freely in relation to each other and often end up becoming misaligned.

Locking hardware is available but it is generally heavy and bulky. The sliding bars generally used in these add a significant thickness to the assembly that is uncomfortable when worn on the shoulder and prone to malfunction due to grit, sand, mud, or corrosion. The long overall length of these buckles also limits the area where it can be placed, and the amount of adjustment one can obtain from it. In the case of ballistic vests a long buckle can lead to an unacceptably large gap between the torso and shoulder portions of the protective vest where a buckle is generally needed. These do provide good "locking" under load however.

Some available flat 2-loop buckles do not function well when used on a tightly curved surface like a shoulder strap. Because they are flat, the loops tend to separate when bent around a curve and allow the strap to slide through. The present invention with a second loop that is bent solves this problem.

Conventional buckles are either generic loops or hardware purpose built for a specific niche industry such as parachuting. What is needed is a buckle specifically designed to meet the needs of the protective vest industry, and in particular vest shoulder strap adjustment buckles. What is needed is an attachment buckle assembly which is high strength (>300 lb failure), lightweight, low-profile in elevation (not thick), short in overall length; and which does not loosen under load.

Further objects, features and advantages of the invention will be apparent from the following detailed description when taken in conjunction with the accompanying drawings.

SUMMARY OF THE INVENTION

The present invention is an attachment buckle assembly which is high strength, lightweight, low-profile in elevation, short in overall length, and which does not loosen under load.

Further objects, features and advantages of the invention will be apparent from the following detailed description when taken in conjunction with the accompanying drawings.

DESCRIPTION OF THE PREFERRED EMBODIMENTS

Figure 1:
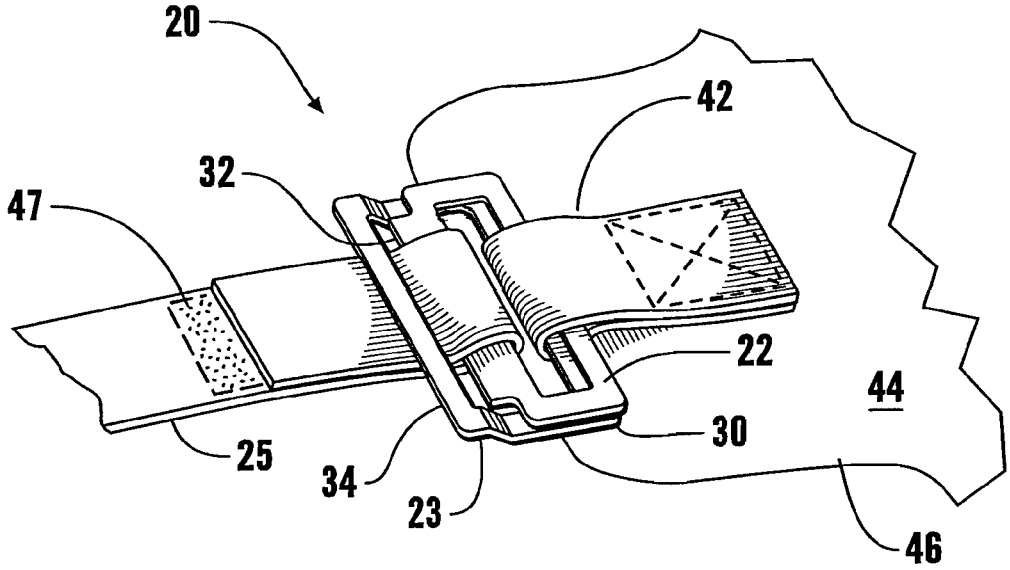
FIG. 1 is an isometric view of the attachment mechanism of this invention mounted to a body armor vest.

Referring more particularly to FIGS. 1-7, wherein like numbers refer to similar parts, a two-part buckle attachment mechanism 20 is shown in FIG. 1. The attachment mechanism 20 is small and low-profile, and it allows securing and adjustment of straps in a very positive manner that is not prone to miss-alignment and unintentional loosening. The mechanism may advantageously be used on shoulder straps of utility vests such as body armor.

Figure 2:
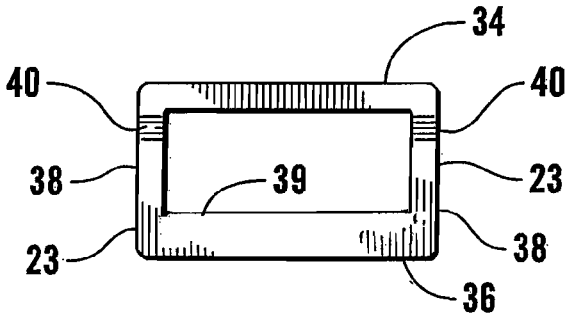
FIG. 2 is a top plan view of a second loop of the attachment mechanism of FIG. 1.
Figure 3:
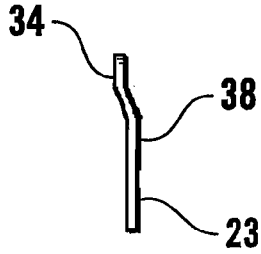
FIG. 3 is a side elevational view of the second loop of FIG. 2.
Figure 4:
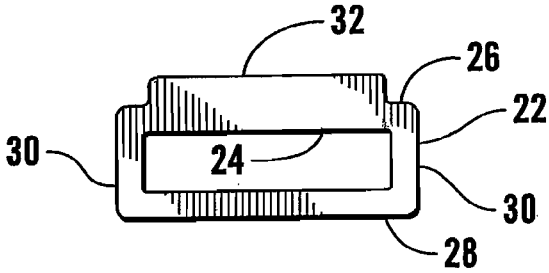
FIG. 4 is a top plan view of a first loop of the attachment mechanism of FIG. 2.
Figure 5:
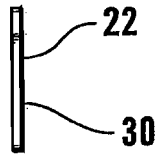
FIG. 5 is a side elevational view of the first loop of FIG. 4.

The attachment mechanism 20 has a first loop 22, shown in FIGS. 4 and 5, and a second loop 23, shown in FIGS. 2 and 3, which are connected by a releasable strap 25 (the strap is shown narrower than desired in FIG. 1 to better show the loop structure). Both loops are preferably fabricated of metal, preferably steel. The first loop 22 is formed as a single flat element having a central opening 24 positioned between a front member 26 and a rear member 28 which is connected to the front member by two side members 30. The front member 26 has a forward projection 32 which defines a locking portion.

The second loop 23 is a generally square ring that is formed to have a step, such that a front member 34 is displaced upwardly from a rear member 36, and connected by two parallel side members 38 which each have a ramp 40 formed therein. The loop 23 has an interior central opening 39.

The first loop 22 rear member 28 is significantly shorter in the front to back direction than is the second loop 23 rear member 36. This insures that the strap 25 feeding through both loops 22, 23 only applies pressure to the second loop which has a much wider rear portion, for example, about 1.4 times the dimension of the first loop rear member 28. This insures that the assembly does not loosen under load, instead it gets tighter as more load is applied.

The bend in the second loop 23 defined by the ramps 40 disposes the front member 34 of the second loop in the same plane as the locking portion forward projection 32 of the first loop 22. The ramped side members 38 provide "tracks" that constrain the side-to-side movement of the first flat loop 22, only allowing it to move front-to-back. This helps keep the loops in proper alignment to one another.

The first loop 22 overlies the second loop 23, and a fixed strap 42 encircles the rear members 28, 36 and is affixed such as by sewing to a shoulder element 44 of a ballistic vest 46, as shown in FIG. 1. The adjustable strap 25 is fixed to a front portion, not shown, of the body armor, and extends beneath the front members 26, 34 of the first loop 22 and the second loop 23, then returns over the forward projection 32 of the first loop 22 and beneath the front member 34 of the second loop. The adjustable strap 25 is then held in place to itself by a hook and loop fastener material 47 such as VELCRO® material manufactured by Velcro Industries B.V. Limited Liability Company, the Netherlands.

As tension is applied to the adjustable strap 46, the first loop is pulled into engagement with the second loop, and the forward projection 32 of the first loop 22 extends toward the front member of the second loop 23. Greater tension causes the forward projection 32 to clamp the strap 46 more securely against the second member front member, as the first loop side members are urged upwardly along the ramps 40 of the second loop.

Figure 6:
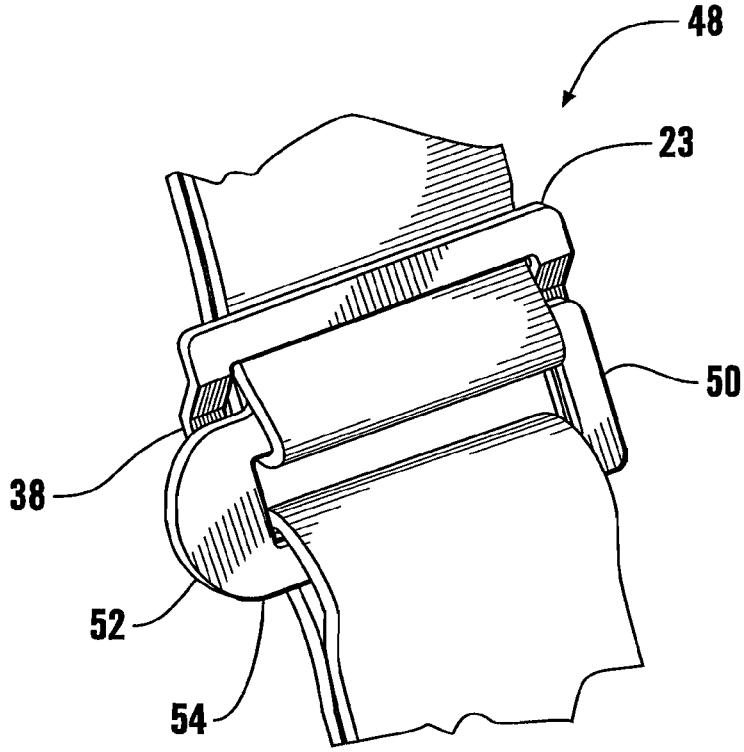
FIG. 6 is a perspective view of an alternative embodiment attachment mechanism of this invention having a side tab on one buckle loop for ease of releasing.

An alternative embodiment attachment mechanism 48 is shown in FIG. 6. The mechanism 48 is identical to the mechanism 20, except that the first loop 50 has a projecting first tab 52 which extends from a side member 54 of the first loop. The first tab 52 thus projects outwardly beyond the width of the side member 38 of the second loop 23, permitting a user to more readily engage the first loop 50 and rotate it with respect to the second loop 23.

Figure 7:
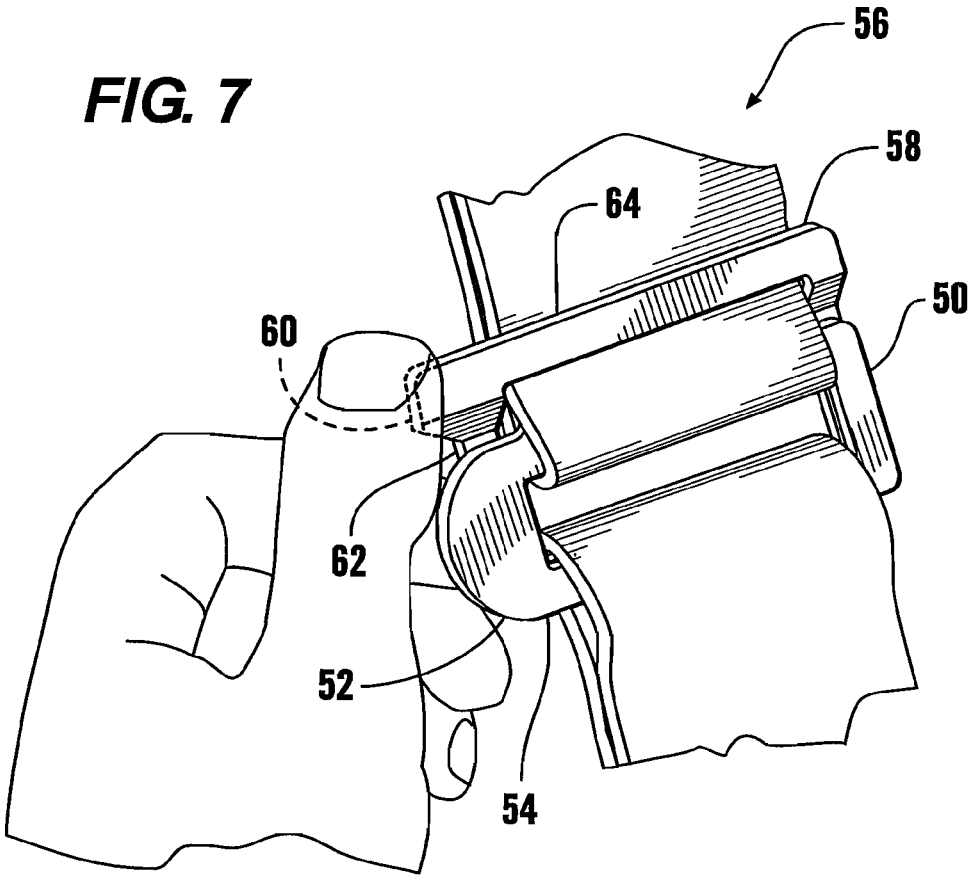
FIG. 7 is a perspective view of another alternative embodiment attachment mechanism of this invention having side tabs on both buckle loops for ease of releasing.

Another alternative embodiment attachment mechanism 56 is shown in FIG. 7. The mechanism 56 is identical to the mechanism 48, except that the second loop 58 also has a projecting second tab 60 which extends sidewardly from a side member 62 of the second loop. The second tab 60 extends from the front member 64 of the second loop and is preferably wider than the front to back distance of the front member, and extends on to a portion of the ramp 40. The second tab 60 is frontward of the first tab 52, and does not overlap the first tab, such that user may engage the first tab and the second tab, and apply pressure to rotate the first loop with respect to the second loop to separate the two loops and thus make it easier to loosen the strap 25 and facilitate readjustment.

It is understood that the invention is not limited to the particular construction and arrangement of parts herein illustrated and described, but embraces all such modified forms thereof as come within the scope of the following claims.

We claim:

1. An attachment assembly comprising:

a rigid first loop having a rear member spaced from a front member by two side members, a central opening being defined between the side members, the front member having a forward projection which extends frontwardly from the front member;

a rigid second loop having a rear member spaced from a front member by two side members, a central opening being defined between the side members, wherein each side member of the second loop has a ramped portion, such that the front member of the second loop is spaced upwardly from the rear member of the second loop, wherein the first loop forward projection is dimensioned to fit within the second loop central opening;

a fixed strap which encircles the rear members of the first loop and the second loop and is fixed to a supporting element; and an adjustable strap which extends beneath the first loop front member and the second loop front member, and which turns over the first loop forward projection and beneath the second loop front member.

2. The assembly of claim 1 wherein a forward direction is defined extending from the first loop rear member to the first loop front member, and wherein a width of the first loop rear member in the forward direction is less than the width of the second loop rear member in the forward direction.

3. The assembly of claim 1 further comprising a first tab which extends from one of the side members of the first loop which projects outwardly beyond the width of one of the side members of the second loop, permitting a user to readily engage the first loop and rotate the first loop with respect to the second loop.

4. The assembly of claim 3 further comprising a second tab which extends sidewardly from the front member of the second loop and is preferably wider than the front to back distance of the front member of the second loop, and extends on to a portion of the ramp of one of the side members of the second loop, the second tab being positioned frontward of the first tab, such that user may engage the first tab and the second tab, and apply pressure to rotate the first loop with respect to the second loop to separate the two loops and thus make it easier to loosen the adjustable strap and facilitate readjustment of the mechanism.

5. The assembly of claim 4 wherein the second tab does not overlap the first tab.

6. The assembly of claim 1 wherein the adjustable strap has portions of hook and loop fastener attached thereto such that the adjustable strap may be releasably secured to itself.

7. An attachment assembly comprising:

a rigid first loop having a rear member spaced from a front member by two side members, a central opening being defined between the side members, the front member having a forward projection which extends frontwardly from the front member;

a rigid second loop having a rear member spaced from a front member by two side members, a central opening being defined between the side members, wherein the side members of the second loop are configured to space the front member of the second loop upwardly from the rear member of the second loop, and wherein the first loop forward projection is dimensioned to fit within the second loop central opening, wherein a forward direction is defined extending from the first loop rear member to the first loop front member, and wherein a width of the first loop rear member in the forward direction is significantly less than the width of the second loop rear member in the forward direction;

a fixed strap which encircles the rear members of the first loop and the second loop and is fixed to a supporting element; and an adjustable strap which extends beneath the first loop front member and the second loop front member, and which turns over the first loop forward projection and beneath the second loop front portion to be releasably secured to itself, such that when tension is placed on the adjustable strap, force is applied to the second loop by the fixed strap.

8. The assembly of claim 7 further comprising a first tab which extends from one of the side members of the first loop which projects outwardly beyond the width of one of the side members of the second loop, permitting a user to readily engage the first loop and rotate it with respect to the second loop.

9. The assembly of claim 8 further comprising a second tab which extends sidewardly from the front member of the second loop and is preferably wider than the front to back distance of the front member, the second tab being positioned frontward of the first tab, such that user may engage the first tab and the second tab, and apply pressure to rotate the first loop with respect to the second loop to separate the two loops and thus make it easier to loosen the adjustable strap and facilitate readjustment of the mechanism.

10. The assembly of claim 9 wherein the second tab does not overlap the first tab.

11. The assembly of claim 7 wherein the adjustable strap has portions of hook and loop fastener attached thereto such that the adjustable strap may be releasably secured to itself.

* * * * *